US005479070A

United States Patent [19]

Murakami

[11] Patent Number: 5,479,070

[45] Date of Patent: Dec. 26, 1995

[54] LIGHT-EMITTING ELEMENT DEVICE

[75] Inventor: Hiroki Murakami, Kanagawa, Japan

[73] Assignee: Fuji Xerox Co., Ltd., Tokyo, Japan

[21] Appl. No.: 80,587

[22] Filed: Jun. 24, 1993

Related U.S. Application Data

[63] Continuation of Ser. No. 699,396, May 14, 1991, abandoned.

[30] Foreign Application Priority Data

May 18, 1990 [JP] Japan ..... 2-126976
Jun. 1, 1990 [JP] Japan ..... 2-141297

[51] Int. Cl.[6] ..... H01J 1/66

[52] U.S. Cl. ..... 313/499

[58] Field of Search ..... 313/495, 496, 313/500, 505, 506, 509, 512

[56] References Cited

U.S. PATENT DOCUMENTS 3,906,285 9/1975 Kobayakawa et al. ..... 313/496

4,924,144 5/1990 Menn et al. ..... 313/500 X

*Primary Examiner*—Sandra L. O'Shea

*Attorney, Agent, or Firm*—Finnegan, Henderson, Farabow, Garrett & Dunner

[57] ABSTRACT

An EL light-emitting element device of a thick-film type and a method of manufacturing such device which is applicable to an image reading device integrally forming a light-emitting element and a light-receiving element, and to provide an image reading device using such an EL light-emitting element device of a thick-film type. In which the light-emitting elements are formed by depositing a light-emitting layer by a thick-film process. Therefore, a light-emitting element device and an image reading device using such a light-emitting element device can be fabricated inexpensively.

6 Claims, 7 Drawing Sheets

LIGHT-EMITTING ELEMENT DEVICE

This application is a continuation of application Ser. No. 07/699,396, filed May 14, 1991, now abandoned.

BACKGROUND OF THE INVENTION

The present invention relates to a light-emitting element device for use in image input sections of such apparatuses as facsimile machines and image scanners. More particularly, it is directed to a light-emitting element device, a method of manufacturing such a light-emitting element device whose light-emitting layer can be formed by a thick-film process which allows inexpensive fabrication, and an image reading device using such light-emitting element device.

To miniaturize image reading devices, what has recently been proposed is an image reading device having its light-emitting element and light-receiving element formed integrally with each other using such a solid-state light source as an electroluminescent (EL light-emitting) element in place of a fluorescent lamp.

In the image reading device of such type, rays of light irradiating the surface of a document are introduced or injected at a right angle thereto in order to prevent illumination from being nonuniform. In addition, in order to shorten the length of an optical path for the light reflected from the document surface to be injected to the light-emitting element, e.g., an EL light-emitting element device 40 is arranged immediately above a light-receiving element array 30 through an adhesive 50 as shown in FIGS. 9 and 10, the light-receiving element array 30 consisting of line-like extending light-receiving elements 31. Light-transmitting portions 60 are formed on the El light-emitting element device 40 at positions corresponding with the respective light-receiving elements 31, so that rays of reflected light 80 from a document surface 70 can be guided into the respective light-receiving elements 31 through the corresponding light-transmitting portions 60.

Each light-transmitting portions 60 of the EL light-emitting element device 40 has the following structure. A transparent electrode 42, an insulating layer 43, a light-emitting layer 44, an insulating layer 45 are sequentially deposited on a transparent substrate 41 by a thin-film process, and a metal electrode 46 is further deposited and then patterned so as to have a rectangular opening portion **46*a* by etching. Since the transparent electrode 42, the insulating layer 43, and the light-emitting layer 44 are made of light-transmitting members, respectively, a portion locating immediately above the opening portion 46*a* provided on the metal electrode 46 constitutes a light-transmitting portion 60**.

However, the above structure uses thin-film type EL light-emitting elements, and this not only increases the fabrication cost but also limits the surface area of each EL light-emitting element due to such restraints as the size of a vacuum chamber used during the thin-film process, thus making it difficult to obtain sufficiently large-sized EL light-emitting elements.

There are EL light-emitting elements whose light-emitting layer is formed by a thick-film process such as screen printing. Although an EL light-emitting element of this type provides a solution to the above problem, it imposes another problem. Specifically, since its light-emitting layer is made of a material in which fluorescent light-emitting particles such as ZnS:Cu or Al are dispersed into an organic binder such as cyanoethylpolyvinyl alcohol (CEPVA), the light-emitting layer does not transmit the reflected light from the document surface efficiently, causing the reflected light to scatter due to a difference in refractive index between the light-emitting particles and the organic binder. As a result, if an EL light-emitting element of a thick-film type is applied to the above-described image reading device integrating its light-emitting element and light-receiving element, then the light-emitting layer portion in the light-emitting element must also be removed. However, the organic binder contained in the light-emitting layer is so highly water-permeable, absorptive, and soluble to organic solvents that it is poor in resistance to etching. In addition, the light-emitting layer deposited by a thick-film process has a thickness of 10 to 100 μm, which does not permit fine patterning. Thus, mere replacement of the EL light-emitting element portion with a thick-film type is not a solid solution to improving the structure and method of manufacturing the exemplary conventional image reading device.

SUMMARY OF THE INVENTION

The present invention has been made in view of the above circumstances. Accordingly, an object of the invention is to provide an EL light-emitting element device of a thick-film type and a method of manufacturing such device which is applicable to an image reading device integrally forming a light-emitting element and a light-receiving element, and to provide an image reading device using such an EL light-emitting element device of a thick-film type.

To achieve the above object, a first aspect of the invention is applied to a light-emitting element device in which a light-emitting element forming portion and a light-transmitting portion are formed. The light-emitting element forming portion is formed first by arranging a pattern which is made of a transparent member and which has a pair of belt-like recessed portions formed on a transparent substrate having a transparent electrode, and then by laminating on each of the belt-like recessed portions a light-emitting layer deposited by a thick-film process and a metal electrode located on the light-emitting layer. The light-transmitting portion transmits light to the light-emitting element portion.

A second aspect of the invention is applied to a method of manufacturing a light-emitting element device which comprises the steps of: forming a belt-like transparent electrode on a transparent substrate; forming a pattern having a pair of belt-like recessed portions on the transparent electrode; forming a light-emitting element by laminating a light-emitting layer on each of the belt-like recessed portions, the light-emitting layer being formed by depositing a light-emitting particles-dispersed resin by a thick-film process; depositing a metal electrode so as to cover the light-emitting layer; and forming an opening portion, which will serve as a light-transmitting portion, on a projected portion formed between the belt-like recessed portions.

A third aspect of the invention is applied to a method of manufacturing a light-emitting element device which comprises the steps of: forming a transparent electrode on a transparent substrate; depositing a light-emitting layer so as to include a belt-like groove portion by screen printing or metal mask printing, the light-emitting layer being formed by depositing a light-emitting particles-dispersed resin on the transparent electrode; and patterning a metal electrode by depositing a metal electrode so as to cover the light-emitting layer and removing the metal member from the belt-like recessed portion.

A fourth aspect of the invention is applied to a method of manufacturing a light-emitting element device which comprises the steps of: forming a transparent electrode on a transparent substrate; attaching a belt-like adhesive tape on the transparent electrode; depositing a light-emitting layer so as to cover the adhesive tape by a thick-film process, the light-emitting layer being formed by depositing a light-emitting particles-dispersed resin on the adhesive tape; forming a belt-like groove portion by removing a part of the light-emitting layer while separating the adhesive tape therefrom; depositing a metal electrode so as to cover the light-emitting layer; and forming an opening portion, which serves as a light-transmitting portion, on the metal electrode located on the belt-like groove portion.

A fifth aspect of the invention is applied to a method of manufacturing a light-emitting element device which comprises the steps of: forming a transparent electrode on a transparent substrate; depositing a light-emitting layer by a thick-film process, the light-emitting layer being formed by depositing a light-emitting particles-dispersed resin on the transparent electrode; forming a belt-like groove portion by removing a part of the light-emitting layer using a tool such as a scraper; depositing a metal electrode so as to cover the light-emitting layer; and forming an opening portion, which serves as a light-transmitting portion, on the metal electrode located on the belt-like groove portion.

A sixth aspect of the invention is applied to an image reading device which comprises: a pair of belt-like light-emitting element forming portions; a light-transmitting portion; and a light-receiving element. Each light-emitting element forming portion is formed by laminating a light-emitting layer and two electrodes on a transparent substrate. The light-emitting layer is formed by depositing a light-emitting particles-dispersed resin by a thick-film process, and the two electrodes interpose the light-emitting layer. The light-transmitting portion transmits light between the light-emitting element forming portions. The light-receiving element is arranged so as to confront the light-transmitting portion. As a result, rays of light emitted from the light-emitting element forming portions are reflected from a surface of a document placed on the transparent substrate, thereby causing the reflected light to pass through the light-transmitting portion and be injected to the light-receiving element, the surface being opposite to the light-emitting element.

A seventh aspect of the invention is applied to a light-emitting element device in which a light-emitting element forming portion and a light-transmitting portion are arranged alternately on a transparent substrate. The light-emitting element forming portion is formed by arranging a plurality of recessed portions on the substrate, and by laminating a light-emitting layer and two electrodes within each of the plurality of recessed portions. The light-emitting layer is deposited by a thick-film process and the two electrodes interpose the light-emitting layer. The light-transmitting portion allows rays of light to pass through.

An eighth aspect of the invention is applied to a method of manufacturing a light-emitting element device which comprises the steps of: forming a plurality of recessed portions on a transparent substrate by a photolithographic method; forming a belt-like transparent electrode on the transparent substrate having the recessed portions already formed; and forming a light-emitting element by laminating a light-emitting layer and a metal electrode on the recessed portion. The light-emitting layer is formed by depositing a light-emitting particles-dispersed resin by a thick-film process and the metal electrode is located on the light-emitting layer.

A ninth aspect of the invention is applied to an image reading device which comprises: a light-emitting element forming portion; a light-transmitting portion; and a light-receiving element. The light-emitting element forming portion is formed by laminating a light-emitting layer and two electrodes on a transparent substrate. The light-emitting layer is formed by depositing a light-emitting particles-dispersed resin by a thick-film process and the two electrodes interpose the light-emitting layer. The light-transmitting portion allows light to pass through the light-emitting element forming portion. The light-emitting element forming portion and the light-transmitting portion are arranged alternately in a main scanning direction of a light-receiving element array so as to allow the light-receiving element to confront the light-transmitting portion. As a result, rays of light emitted from the light-emitting element forming portion are reflected from a surface of a document placed on the transparent substrate, thereby causing the reflected light to pass through the light-transmitting portion and to be injected to the light-receiving element, the surface being opposite to the light-emitting element.

According to the light-emitting element device of the first aspect of the invention, the pattern having a pair of belt-like recessed portions is arranged on the transparent substrate to form an EL light-emitting element in each belt-like recessed portion. Therefore, the belt-like light-transmitting portion can be formed between the belt-like recessed portions without etching the light-emitting layer of the EL light-emitting element.

According to the method of manufacturing a light-emitting element device of the second aspect of the invention, the pattern having a pair of belt-like recessed portions is arranged on the transparent substrate to form an El light-emitting element in each belt-like recessed portion. Therefore, the projected portion in the irregular pattern serves as the light-transmitting portion, allowing the light-emitting layer of the EL light-emitting element to be deposited by a thick-film process.

According to the method of manufacturing a light-emitting element device of the third aspect of the invention, the belt-like groove portion serving as the light-transmitting portion is formed on the light-emitting layer at the time the light-emitting layer is being screen-printed or metal-mask printed. Therefore, the light-emitting layer of the EL light-emitting element can be formed by a thick-film process.

According to the method of manufacturing a light-emitting element device of the fourth aspect of the invention, the belt-like groove portion serving as the light-transmitting portion is formed on the light-emitting layer while separating the adhesive tape attached to the transparent substrate. Therefore, the light-emitting layer of the EL light-emitting element can be formed by a thick-film process.

According to the method of manufacturing a light-emitting element device of the fifth aspect of the invention, the belt-like recessed groove portion serving as the light-transmitting portion is formed by removing part of the light-emitting layer using a scraper or the like. Therefore, the light-emitting layer of the EL light-emitting element can be formed by a thick-film process.

According to the image reading device of the sixth aspect of the invention, the pair of light-emitting element forming portions are formed; the light-transmitting portion allowing light to pass through the light-emitting element forming portions is arranged; and the light-receiving element is arranged so as to face the light-transmitting portion. Therefore, the reflected light from the document surface can be guided to each light-receiving element through the corresponding light-transmitting portion.

According to the light-emitting element device of the seventh aspect of the invention, a plurality of recessed portions are arranged on the transparent substrate to form an EL light-emitting elements in each recessed portion. Therefore, the light-transmitting portion can be formed between the recessed portions without etching the light-emitting layer of the EL light-emitting element.

According to the method of manufacturing a light-emitting element device of the eighth aspect of the invention, a plurality of recessed portions are arranged on the transparent substrate to form an EL light-emitting element in each recessed portion. Therefore the light-emitting layer of the EL light-emitting element can be formed by a thick-film process.

According to the image reading device of the ninth aspect of the invention, the light-emitting element forming portions and the light-transmitting portions are arranged alternately in the main scanning direction of the light-receiving element array, and each light-receiving element is located so as to correspond with the light-transmitting portion. Therefore, the reflected light from the document surface can be guided to each light-receiving element through the corresponding light-transmitting portion.

DESCRIPTION OF THE PREFERRED EMBODIMENTS

An electroluminescent (EL) light-emitting element device, which is an embodiment of the invention, will be described with reference to FIG. 1F and FIG. 2A.

Figure 1A:
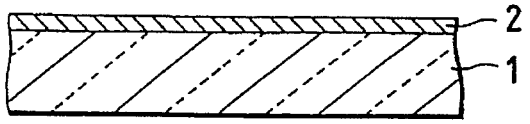
FIGS. 1A to 1F are process diagrams showing a process for manufacturing a light-emitting element device, which is an embodiment of the invention.
Figure 1B:
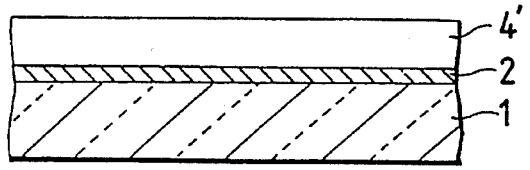
Figure 1C:
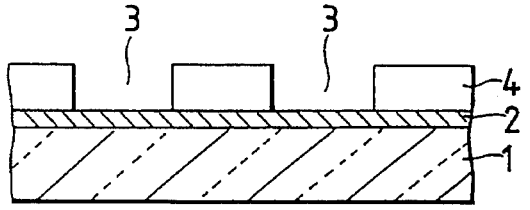
Figure 1D:
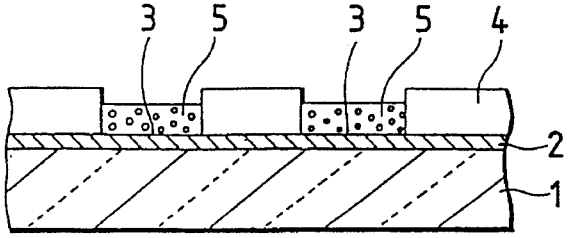
Figure 1E:
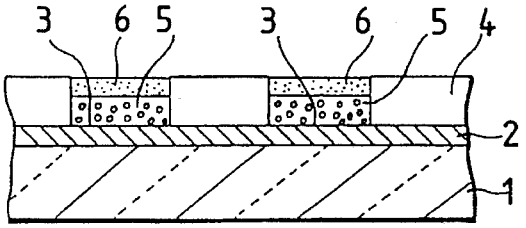
Figure 1F:
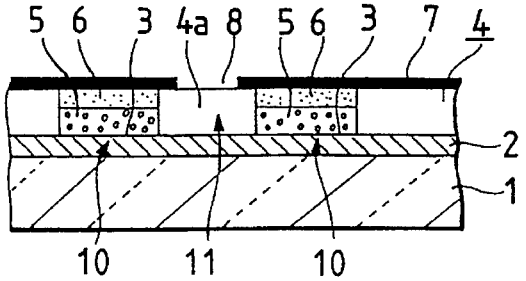
Figure 2A:
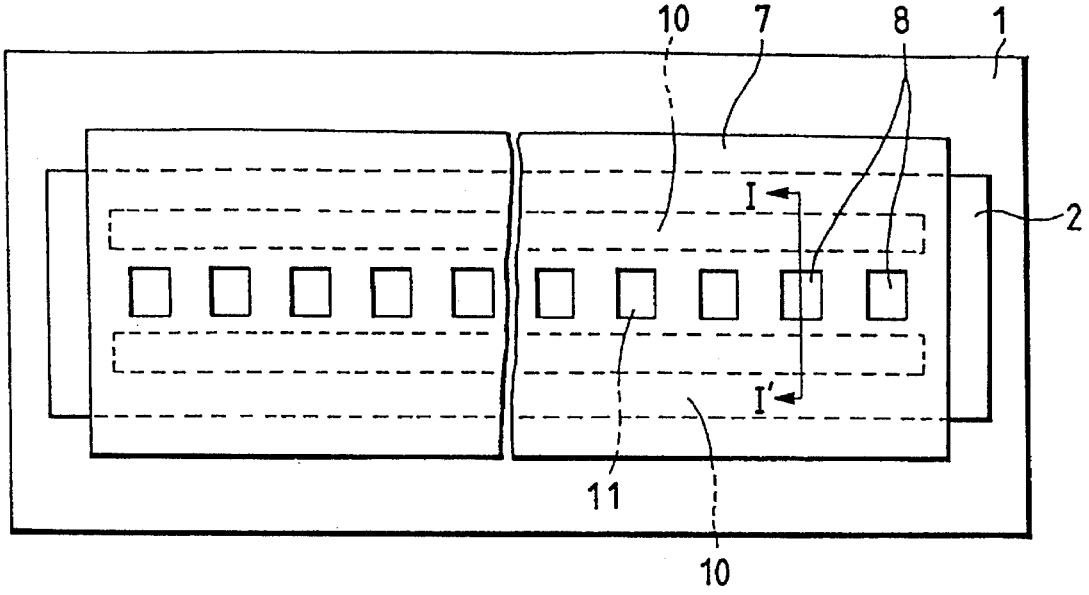
FIGS. 2A and 2B are plan views illustrating the light-emitting element device of the invention.

FIG. 1F is a sectional view illustrative of a portion taken along a line 1F—1F' shown in FIG. 2A.

The EL light-emitting element device is formed of a transparent substrate 1, on which a transparent electrode 2 is deposited and a convex-concave pattern 4 having a pair of belt-like recessed portions 3, 3, each being made of a transparent member, is formed. Each belt-like recessed portion 3 has a light-emitting layer 5 and a dielectric layer 6 sequentially laminated thereon so that the upper surface of the projected portion of the convex-concave pattern 4 is coplanar with the upper surface of the dielectric layer 6. The light-emitting layer 5 is formed by depositing a light-emitting particles-dispersed resin by a thick-film process. Further, a metal electrode 7 is formed so as to cover the dielectric layer 6, and on the metal electrode 7 are a plurality of rectangular openings 8 arranged so as to correspond with light-receiving elements (later described). Therefore, a light-transmitting portion 11 that transmits light therethrough is arranged between two light-emitting element forming portions 10 formed by interposing the light-emitting layer 6 between the transparent electrode 2 and the metal electrode 7. As a result of the above structure, light is emitted from the light-emitting layer 5 which gets biased upon application of an AC voltage between the transparent electrode 2 and the metal electrode 7 interposing the light-emitting layer 5 therebetween.

A method of manufacturing this EL light-emitting element device will be described with reference to FIGS. 1A to 1F.

A transparent electrode 2 is formed on a 50 μm thick transparent substrate made of, e.g., a boro-silicate glass by depositing a transparent electroconductive film made of, e.g., ITO (indium-tin oxide) to a thickness of 1000 Å by EB deposition (FIG. 1A).

A transparent silicone resin 4' (JCR-6125 manufactured by Tore Silicone) is screen-printed on the transparent substrate 1 having the transparent electrode 2 already deposited (FIG. 1B) and is then subjected to a thermosetting process at 150° C. for 1 hour to form a 50 μm thick of convex-concave pattern 4 that has a pair of belt-like recessed portions 3 (FIG. 1C).

A light-emitting member is screen-printed in each belt-like recessed portion 3 and dried to form a 30 μm thick light-emitting layer 5 (FIG. 1D). The light-emitting member is formed by dispersing a fluorescent body in an organic binder of cyanoethylcellulose, the fluorescent body being formed by doping an activator (0.08%Cu, 0.02%Al) into a ZnS fluorescent mother body whose average grain size is 10 μm. The light-emitting member may also be formed by classifying a material selected from the group consisting of ZnS:Cu, Cl ZnS:Cu, Br ZnS:Cu, Mn, Cl ZnCdS:Cu, Br or a mixture thereof, and then by dispersing such classified material or mixture into a binder such as an acetal resin, an epoxy resin, a methylmetacrylate resin, a polyester resin, a cyanoethylcellulose resin, or a fluorine-containing resin.

Then, a dielectric member is deposited on the light-emitting layer 5 by screen-printing and dried to form a 20 μm thick dielectric layer 6 (FIG. 1E). The dielectric member is formed by dispersing $BaTiO_3$ whose average grain size is 1 μm into an organic binder of cyanoethylpolyvinyl alcohol (CEPVA). The dielectric layer 6 may be formed by applying, by a thick-film process such as screen printing or spray plating, a dielectric member including a low-melting point glass, cyanoethylcellulose, a vinylidene fluoride-containing ternary copolymer, a vinylidene fluoride—trifluoroethylene copolymer, an epoxy resin, and a silicone resin.

Then, aluminum Al is deposited so as to cover the dielectric layer 6 to a thickness of 1.5 μm by a vapor deposition method to form a metal electrode 7, and a plurality of rectangular openings 8 are thereafter formed on a projected portion 4*a* of the pattern 4 by a photolithography-based etching process (FIG. 1F). The metal may be deposited by the spray-plating method or a CVD (chemical vapor deposition) method. In etching the metal electrode 7 to form the rectangular opening 8, the light-emitting layer 5 and the dielectric layer 6 are not exposed to the etching solution because the opening 8 is formed at a position corresponding to the projected portion 4*a* of the pattern 4. This prevents the light-emitting layer 5 and the dielectric layer 6 from being damaged by the etching process.

Figure 2B:
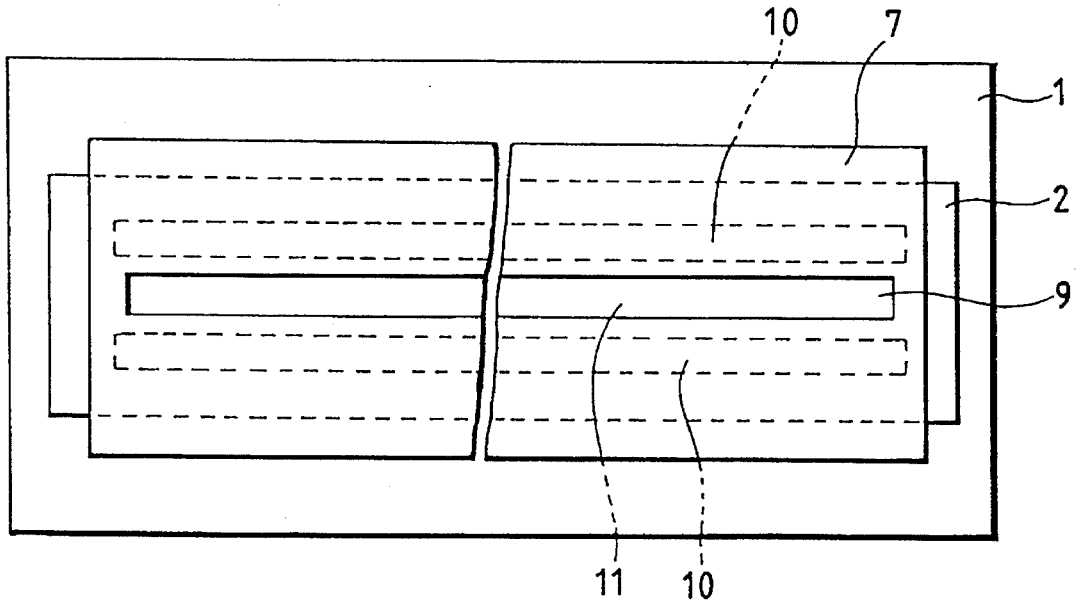

While a plurality of openings 8 are formed on the metal electrode 7 in this embodiment as shown in FIG. 2A, a belt-like rectangular opening 9 may be formed along the projected portion 4*a* of the pattern 4 as shown in FIG. 2B.

While the boro-silicate glass is used as the transparent substrate 1 in the above embodiment, other types of glass, films such as PET, or epoxy plates may be used as long as they are transparent.

While the irregular pattern 4 is formed by screen printing in the above embodiment, it may be formed directly by a resin coater, or by patterning a transparent film to a desired thickness and bonding such a patterned film.

According to the above embodiment, the light-emitting layer 5 and the dielectric layer 6 are not exposed to the etching solution, thereby allowing light-emitting members and dielectric members with a poor etching resisting property to be used and thus contributing to increasing the scope of material selection.

Figure 3:
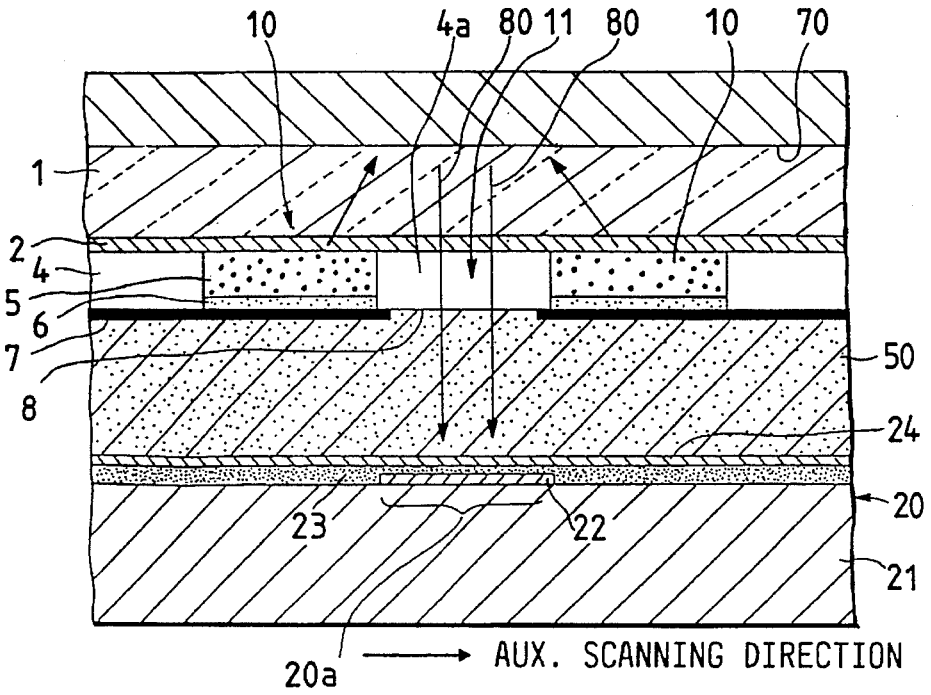
FIG. 3 is a sectional view illustrating an image reading device using the light-emitting element device manufactured by the process shown in FIGS. 1A to 1F.

FIG. 3 shows an exemplary image reading device to which the EL light-emitting element device manufactured by the steps shown in FIGS. 1A to 1F is applied.

Specifically, the above EL light-emitting element device and a light-receiving element array 20 are integrally formed through a light-transmitting adhesive 50. Respective light-receiving elements 20*a*, each being disposed in the main scanning direction (from front to back as viewed from FIG. 3) to constitute the light-receiving element array 20, are arranged so that each light-receiving element 20*a* positions just below the light-transmitting portion 11 of the EL light-emitting element device. The light-receiving element array 20 is formed on the substrate 21 so that its length corresponds to the width of a document. Each light-receiving element 20*a* is of such a thin-film sandwiched structure that a belt-like photoconductive layer 23 is interposed between an individual electrode 22 and a common electrode 24. The individual electrode 22 is made of Cr and segmented sparsely; the common electrode 24 is made of ITO and extends to be belt-like; and the photoconductive layer 23 is made of amorphous silicon (a-Si), all extending in the direction from front to back as viewed from FIG. 3.

When an AC voltage of about 50 to 250V is applied between the transparent electrode 2 and metal electrode 7 of the EL light-emitting element device, the light-emitting layer 5 interposed between both electrodes emits light, irradiating a surface 70 of a document placed on the transparent substrate 1. The reflected light 80 from the document surface 70 passes through each light-transmitting portion 11 and is injected into each light-receiving element 20*a* disposed just below the light-transmitting portion 11 to generate electric charges. The electric charges are outputted from the light-receiving element 20*a* as a signal through control of a drive IC (not shown), so that image information can be obtained.

If the light-emitting element device having a plurality of openings 8 in the metal electrode 7 is used as shown in FIG. 2A, then a specific light-emitting portion irradiates a specific document surface portion, thereby preventing generation of unnecessarily irradiated rays of light compared with a case where the document surface 70 is uniformly irradiated. Therefore, such a structure prevents irradiation of the reflected light from the specific document surface to light-receiving elements which are adjacent to a light-receiving element to which the reflected light must be injected. Thereby, the resolution (MTF) of the light-emitting element device is improved by reducing the ratio of unnecessary reflected light.

FIGS. 4A to 4E show another embodiment of the invention, which is a method of manufacturing an EL light-emitting element device by a thick-film process without forming the convex-concave pattern 4 as described above.

Figure 4A:
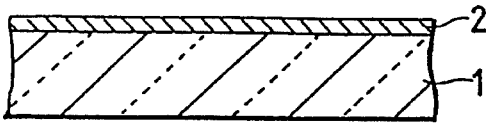
FIGS. 4A to 4E are process diagrams showing a process for manufacturing a light-emitting element device, which is another embodiment of the invention.

A transparent electrode 2 is formed on a transparent substrate 1 made of, e.g., glass or plastic by depositing a transparent electroconductive film made of, e.g., ITO, by the spray plating, CVD, or vapor deposition method (FIG. 4A).

Figures 1, 4B:
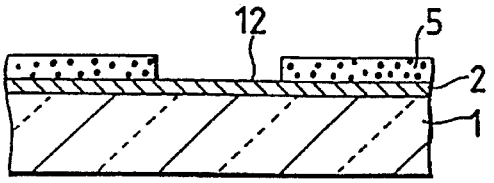
Figures 2, 4B:
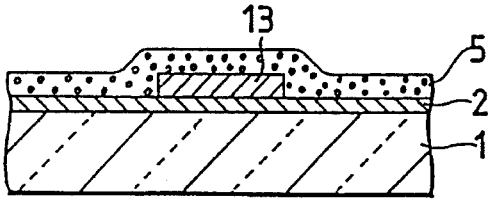
Figures 3, 4B:
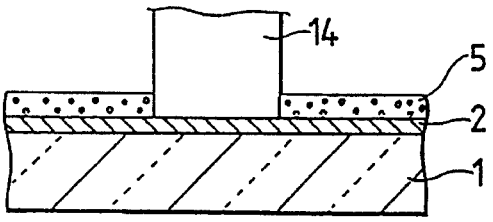

A light-emitting member is deposited on the transparent substrate 1, on which the transparent electrode 2 has been deposited, by screen printing or metal-mask printing to form a light-emitting layer 5 having a belt-like groove portion 12 that extends from front to back as viewed from the figure (FIG. 4B-1). Alternatively, the light-emitting layer 5 having the belt-like groove portion 12 may be formed by attaching a belt-like adhesive tape 13 on the transparent electrode 2 in advance and detaching the adhesive tape 13 after a light-emitting member has been entirely printed so that a portion of the light-emitting member can be separated (FIG. 4B-2). The groove portion 12 may be formed by removing a portion of the light-emitting member so as to be belt-like using a scraper 14 or the like (FIG. 4B-3). The same light-emitting member as used in the previous embodiment is used.

Figure 4C:
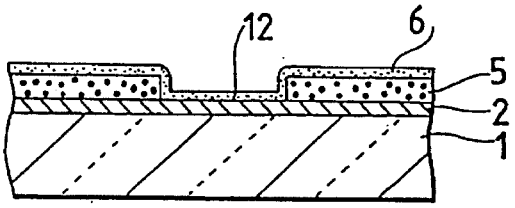
Figure 4D:
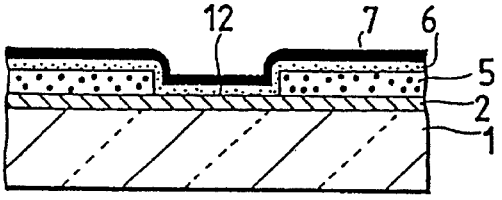

Then, a dielectric member is deposited so as to cover the light-emitting layer 5 by the screen printing or spray plating method to form a dielectric layer 6 (FIG. 4C). The dielectric member is formed by dispersing $BaTiO_3$ whose average grain size is 1 μm into an organic binder of CEPVA. The dielectric layer 6 may be formed by applying, by a thick-film process such as the screen printing or spray plating method, a dielectric member including a low-melting point glass, cyanoethylcellulose, a vinylidene fluoride-containing ternary copolymer, a vinylidene fluoride - trifluoroethylene copolymer, an epoxy resin, and a silicone resin. A binder whose etching resistant property is high is used in the dielectric layer 6 to keep the dielectric particles from being influenced by hygroscopic properties or the like encountered during an etching process, which is a process next to the thick-film process.

Figure 4E:
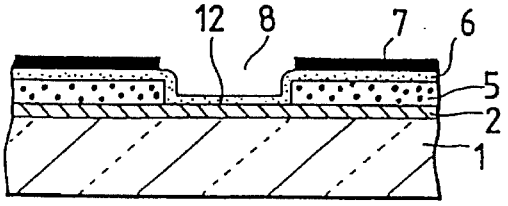

Then, a metal such as Al is deposited so as to cover the dielectric layer 6 to a thickness of 1.5 μm by the vapor deposition method to form a metal electrode 7 (FIG. 4D), and a plurality of rectangular openings 8 are thereafter formed on the groove portion by a photolithography-based etching process (FIG. 4E). Similar to the previous embodiment, a rectangular opening 9 (FIG. 2B) may be formed so as to extend belt-like along the groove portion from front to back as viewed from the figure. The metal may be deposited by the spray-plating or CVD method.

Figure 5:
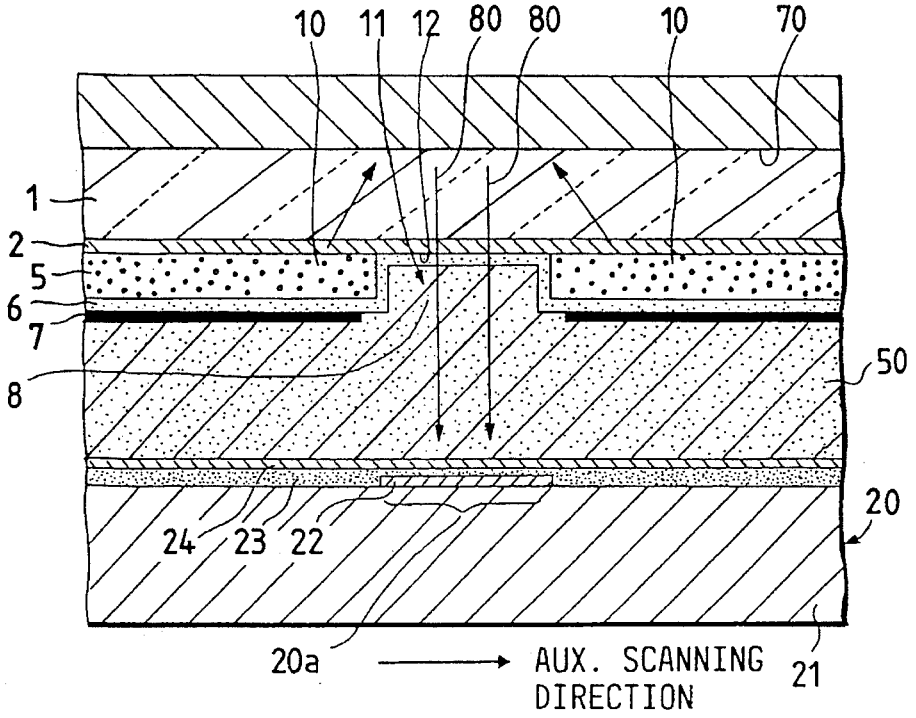
FIG. 5 is a sectional view illustrating an image reading device using the light-emitting element device manufactured by the process shown in FIGS. 4A to 4E.

FIG. 5 shows an exemplary image reading device to which the EL light-emitting element device manufactured by the steps shown in FIGS. 4A to 4E is applied. The same parts and components as in FIG. 3 are designated by the same reference numerals, and detailed descriptions thereof will be omitted. In this embodiment, an adhesive 50 is used to load the groove portion 12 to form a light-transmitting portion 11.

According to the above embodiments, the metal electrode 7 is subjected to an etching process based on a photolithographic method, while the other deposition processes can be ordinary thick-film processes. Therefore, EL light-emitting elements having a large surface area can be produced inexpensively.

In addition, the light-emitting layer 5 which is less resistant to humidity is enclosed by the irregular pattern 4 and the dielectric layer 6 in the embodiment manufactured by the steps shown in FIGS. 1A to 1F, while the light-emitting layer 5 is covered with the dielectric layer 6 in the embodiment manufactured by the steps shown in FIGS. 4A to 4E. Therefore, the light-emitting layer 5 is less susceptible to external influence, thereby allowing the EL light-emitting elements to exhibit high reliability to environmental conditions.

Another exemplary light-emitting element device, which is still another embodiment of the invention, will be described with reference to FIG. 6G and FIG. 7.

Figure 6A:
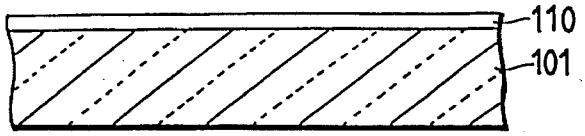
FIGS. 6A to 6G are process diagrams showing a process for manufacturing a light-emitting element device, which is still another embodiment of the invention.
Figure 6B:
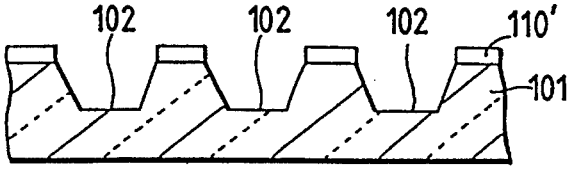
Figures 1, 6C:
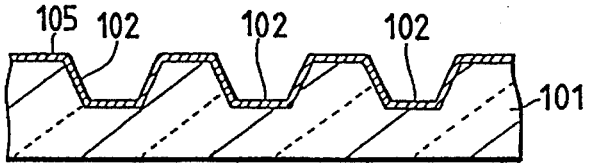
Figures 2, 6C:
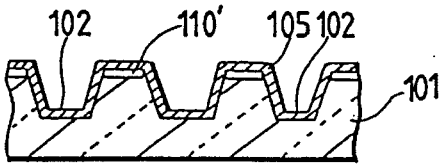
Figures 3, 6C:
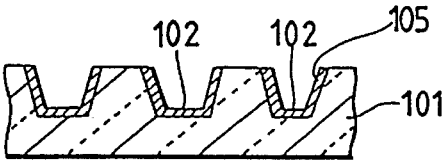
Figure 6D:
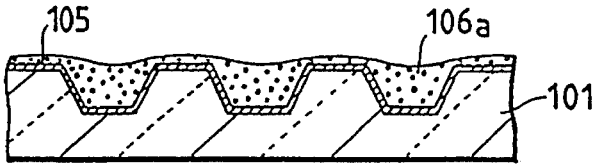
Figure 6E:
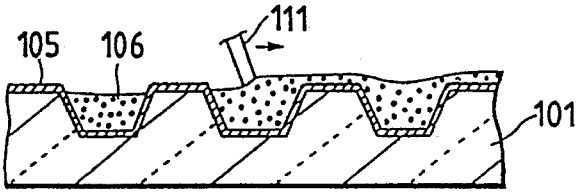
Figure 6F:
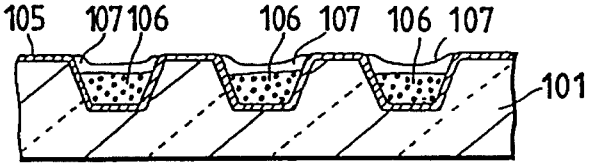
Figure 6G:
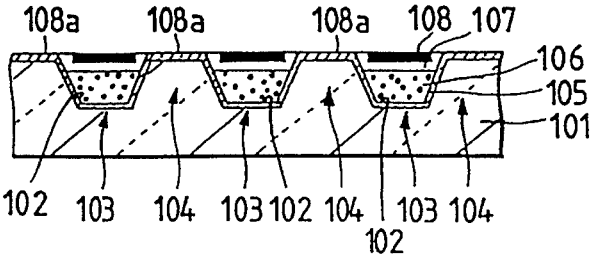
Figure 7:
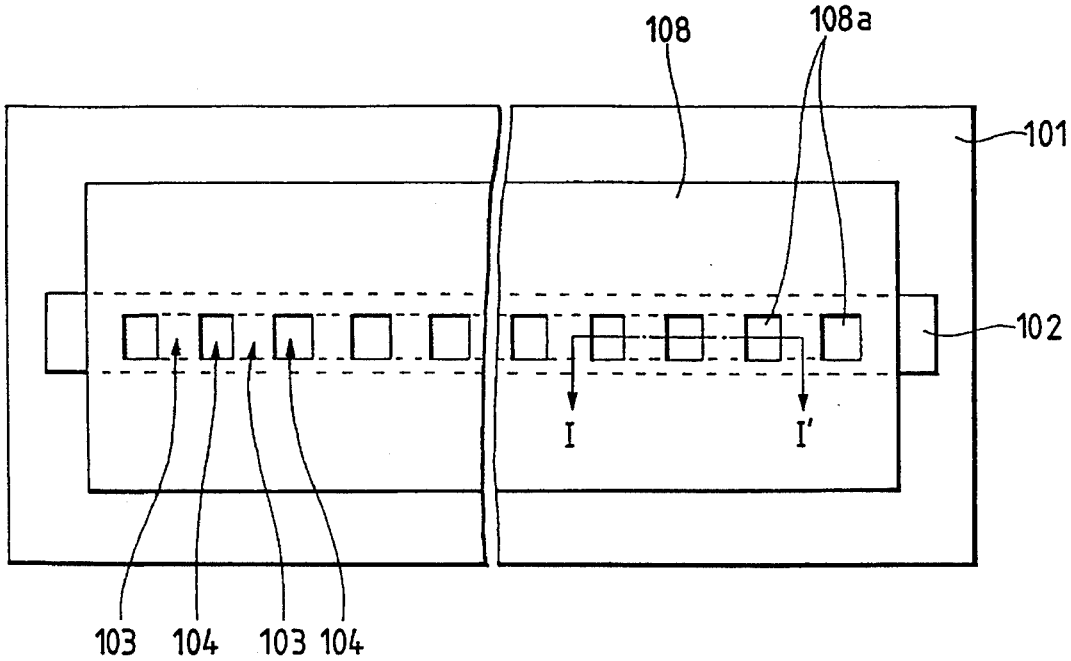
FIG. 7 is a plan view illustrating the light-emitting element device of the invention.

FIG. 6G is a sectional view illustrative of a portion taken along a line 6G—6G' shown in FIG. 7.

The EL light-emitting element device is formed of a transparent substrate 101, on which a plurality of recessed portions 102 are cyclically formed along the length of the transparent substrate 101 and light-emitting element forming portions 103 are formed in the respective recessed portions 102, so that a light-emitting element forming portion 103 and a light-transmitting portion 104 transmitting light therethrough can be arranged alternately. In each recessed portion 102 are a transparent electrode 105, a light-emitting layer 106, a dielectric layer 107, and a metal electrode 108 sequentially deposited, the light-emitting layer 106 being formed by depositing a light-emitting particles-dispersed resin by a thick-film process. As a result of the above structure, the light-emitting layer 106 emits light when biased upon application of an AC voltage between the transparent electrode 105 and the metal electrode 108 interposing the light-emitting layer 106 therebetween.

A method of manufacturing this EL light-emitting element device will be described with reference to FIGS. 6A to 6G.

A resist 110 is applied to the entire surface of a 100 μm thick transparent substrate 101 made of, e.g., glass (FIG. 6A), exposed and developed to form a resist pattern 110' while removing the resist from a portion corresponding to each light-emitting element forming portion.

Then, the transparent substrate 101 below the portion from which the resist has been removed is wet-etched using an etching solution such as hydrofluoric acid to form a plurality of recessed portions 102 of 50 to 60 μm in depth (FIG. 6B), and the resist pattern 110' is thereafter removed.

A transparent electrode 105 made of, e.g., ITO, is then deposited so as to cover each recessed portion 102 by the spray-plating or CVD method, or a physical vapor deposition (PVD) method (FIG. 6C-1). Alternatively, a film made of, e.g., ITO, may be deposited after having formed the resist pattern 110' (FIG. 6C-2) and the transparent electrode 105 may be formed only within each recessed portion 102 by a lift-off method (FIG. 6C-3).

Then, a light-emitting member 106*a* is entirely applied by the screen printing or spray plating method (FIG. 6D), and a film applied outside each recessed portion 102 is then removed using a scraper 111 or by polishing or the like to form a light-emitting layer 106 (FIG. 6E). The light-emitting member is formed by classifying a material selected from the group consisting of ZnS:Cu, Cl ZnS:Cu, Al ZnS:Cu, Br ZnS:Cu, Mn, Cl ZnCdS:Cu, Br or a mixture thereof, and then by dispersing such classified material or mixture into a binder such as an acetal resin, an epoxy resin, a methylmetacrylate resin, a polyester resin, a cyanoethylcellulose resin, or a fluorine-containing resin.

Then, a dielectric member is entirely applied by such a thick-film process as the screen-printing or spray plating method, and a portion of the applied film outside each recessed portion 102 is similarly scraped by the scraper or by polishing or the like to form a dielectric layer 107 (FIG. 6F). The dielectric member includes a low-melting point glass, cyanoethylcellulose, a vinylidene fluoride-containing ternary copolymer, a vinylidene fluoride - trifluoroethylene copolymer, an epoxy resin, and a silicone resin.

Lastly, a metal such as Al is entirely deposited by the spray plating, CVD, or PVD method and is subjected to a photolithography-based etching process to pattern a metal electrode 108 so that rectangular openings 108*a* are positioned above the projected portion of the transparent substrate 101. The patterning is performed in such a manner that the light-emitting element forming portion 103 formed within each recessed portion 102 and the light-transmitting portion 104 formed below each opening portion 108*a* can be arranged alternately (FIG. 6G).

Figure 8:
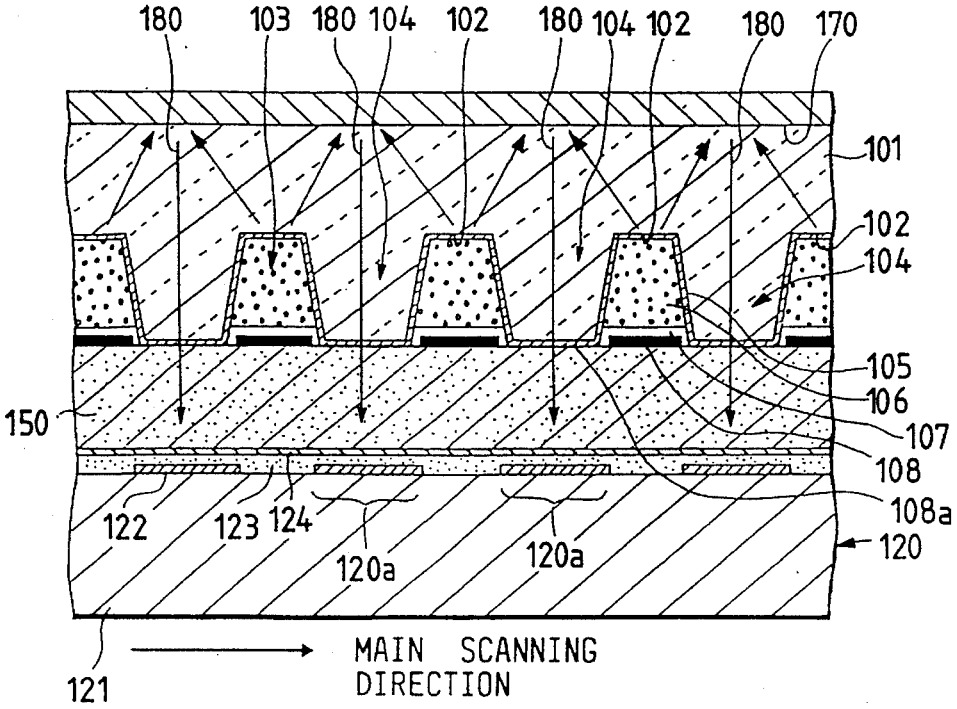
FIG. 8 is a partially sectional view illustrating an image reading device using the light-emitting element device manufactured by the process shown in FIGS. 6A to 6G.
Figure 9:
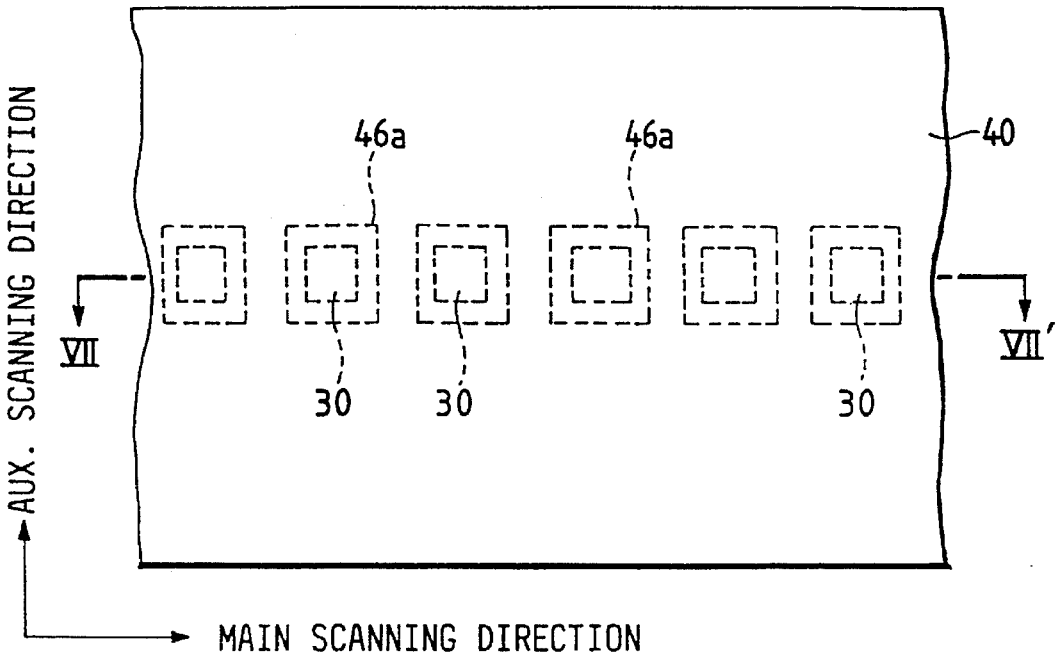
FIG. 9 is a plan view illustrating a conventional image reading device in which a light-emitting element, a light-receiving element are integrally formed.
Figure 10:
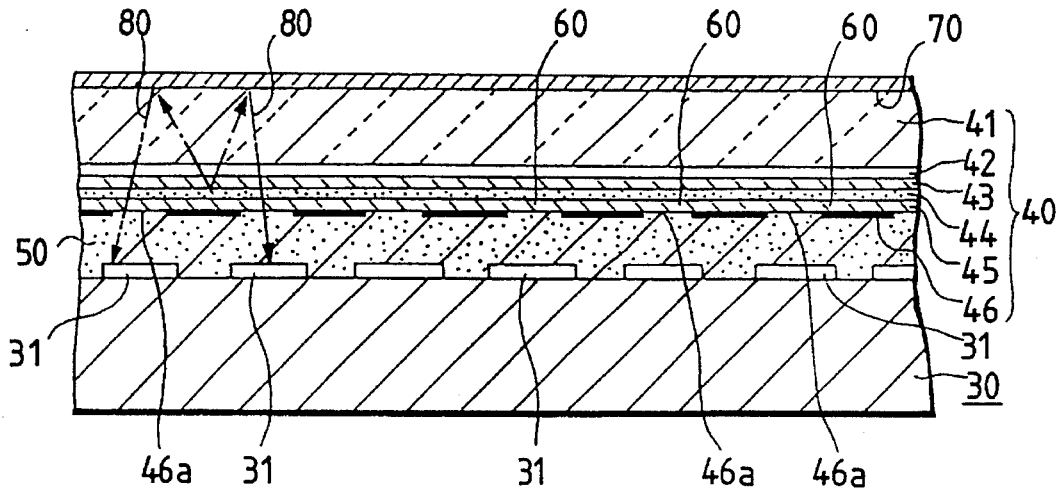
FIG. 10 is a sectional view taken along a line 10—10' in FIG. 9.

FIG. 8 shows an exemplary image reading device to which the EL light-emitting element device manufactured by the steps shown in FIGS. 6A to 6G is applied.

Specifically, the above EL light-emitting element device and a light-receiving element array 120 are integrally formed through a light-transmitting adhesive 150. A multiplicity of light-receiving elements 120*a*, each being disposed in the main scanning direction to constitute the light-receiving element array 120, are bonded to the light-receiving element array 120 so that each light-receiving element 120*a* is positioned right below the light-transmitting portion 104 of the EL light,emitting element device. The light-receiving element array 120 is formed on the substrate 121 so that its length corresponds to the width of a document. Each light-receiving element 120*a* is of such a thin-film sandwiched structure that a belt-like photoconductive layer 123 is interposed between an individual electrode 122 and a common electrode 124. The individual electrode 122 is made of Cr and segmented sparsely; the common electrode 124 is made of ITO and extends to be belt-like; and the photoconductive layer 123 is made of a-Si, all extending in the main scanning direction. The light-receiving element is not limited thereto, but may be a CCD (charge-coupled device) or the like.

When an AC voltage of about 50 to 250V is applied between the transparent electrode 105 and metal electrode 108 of the above EL light-emitting element device, the light-emitting layer 106 interposed between both electrodes emits light, irradiating a surface 170 of a document placed on the transparent substrate 101. The reflected light 180 from the document surface 170 passes through each light-transmitting portion 104 and is injected into each light-receiving element 120*a* disposed right below the corresponding light-transmitting portion 104 to generate electric charges. The electric charges are outputted from the light-receiving element 120*a* as a signal through control of a drive IC (not shown), so that image information can be obtained.

According to this embodiment, the light-emitting layer 106 is formed within each recessed portion 102 of the transparent substrate 101. Therefore, the document surface 170 can be placed close to the light-receiving elements 120*a*, thereby allowing the reflected light 180 from the document surface 170 to be utilized efficiently. In addition, the light-emitting element forming portion 103 and the light-transmitting portion 104 are formed alternately so that the light-emitting portions are arranged sparsely. This allows a specific light-emitting portion to irradiate a specific document surface portion, thereby preventing generation of unnecessarily irradiated rays of light compared with a case where the document surface 170 is uniformly irradiated. Therefore, such a structure prevents irradiation of the reflected light from the specific document surface to light-receiving elements which are adjacent to a light-receiving element to which the reflected light must be injected, thereby improving the resolution (MTF) of the light-emitting element device by reducing the ratio of unnecessary reflected light.

Further, while the transparent substrate 101 and the metal electrode 108 are subjected to a photolithography-based etching process, other deposition processes can be ordinary thick-film processes, thereby allowing the EL light-emitting elements with a large surface area to be produced inexpensively.

Furthermore, the structure of having the light-emitting layer 106, which is less resistant to moisture, embedded in each recessed portion 102 of the transparent substrate 101 contributes to making the EL light-emitting elements less susceptible to external influence and highly reliable to environmental conditions.

The exemplary image reading devices consisting of a single line of light-receiving elements and EL light-emitting elements have been described in the above embodiments. However, if an image reading device has a plurality of lines juxtaposed to read, e.g., color images, with the respective EL light-emitting elements being staggered by a single bit in the main scanning direction and with the light-emitting portions and the light-transmitting portions being arranged alternately in the auxiliary scanning direction as well, then the MTF of the light-emitting element device in the auxiliary scanning direction can be improved.

As described in the foregoing, according to the invention, the feature of producing the light-emitting elements by depositing the light-emitting layer by a thick-film process. Therefore, a light-emitting element device and an image reading device using such a light-emitting element device can be fabricated inexpensively. In addition, a feature of the thick-film process which does not limit the deposition area allows a light-emitting element device to have a large surface area. Further, the structure that the light-emitting layer is formed within the recessed portion of the transparent substrate not only allows the light-emitting element device that is highly reliable to environmental conditions to be produced, but also contributes to making the device thinner as a whole.

Moreover, the feature of arranging the light-emitting element forming portion and the light-transmitting portion alternately to segment the light-emitting portion sparsely allows a specific light-emitting portion to irradiate a specific document surface portion. This arrangement prevents generation of unnecessarily irradiated rays of light compared with a case where the document surface 70 is uniformly irradiated, thereby improving the resolution (MTF) by reducing the ratio of unnecessarily reflected light.

What is claimed is:

1. A light-emitting element device providing reflected light to a light receiving element portion, said light-emitting element device comprising:

a transparent substrate having a surface;

at least one transparent electrode disposed on said surface;

a plurality of thick-film light-emitting portions deposited on said transparent electrode for emitting light in a given direction;

at least one light-transmitting portion, arranged alternately with said plurality of light-emitting portions, establishing at least one light conduit for transmitting therethrough reflected light travelling substantially opposite to said given direction; and at least one second electrode formed such that said plurality of light-emitting portions are interposed between said at least one second electrode and said at least one transparent electrode.

2. A light-emitting element device according to claim 1, wherein said plurality of light-emitting portions have a thickness from 10 to 100 μm.

3. A light-emitting element device for providing reflected light to a light receiving element portion, said light-emitting element device comprising:

a transparent substrate having a surface;

a transparent electrode deposited on said surface;

a convex-concave pattern formed on said transparent electrode, said convex-concave pattern being a transparent member having a pair of belt-like recessed portions;

a pair of thick-film light-emitting element portions laminated with said pair of belt-like recessed portions, said pair of light-emitting element portions each comprising a light-emitting layer for emitting light in a given direction and a metal electrode, said light-emitting layer interposed between said metal electrode and said transparent electrode; and a light-transmitting portion disposed between said light-emitting element portions establishing a light conduit for transmitting therethrough reflected light travelling substantially opposite to said given direction.

4. A light-emitting element device according to claim 3, wherein said light-emitting element portion has a thickness from 10 to 100 μm.

5. A light-emitting element device for providing reflected light to a light receiving element portion, said light-emitting element device comprising:

a transparent substrate having a surface;

a plurality of recessed portions on said surface;

a plurality of thick-film light-emitting element portions for emitting light in a given direction, said light-emitting element portions each comprising a light-emitting layer interposed between two electrodes and each within one of said plurality of recessed portions; and at least one light-transmitting portion arranged alternately on said surface with said plurality of light-emitting element portions, establishing at least one light conduit for transmitting therethrough reflected light travelling substantially opposite to said given direction.

6. A light-emitting element device according to claim 5, wherein said at least one light-emitting element portion has a thickness from 10 to 100 μm.

* * * * *